US011621018B2

(12) United States Patent
Georganti et al.

(10) Patent No.: US 11,621,018 B2
(45) Date of Patent: Apr. 4, 2023

(54) DETERMINING SOCIAL INTERACTION OF A USER WEARING A HEARING DEVICE

(71) Applicant: SONOVA AG, Staefa (CH)

(72) Inventors: Eleftheria Georganti, Zollikon (CH); Gilles Courtois, Uerikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/590,948

(22) Filed: Feb. 2, 2022

(65) Prior Publication Data

US 2022/0254367 A1 Aug. 11, 2022

(30) Foreign Application Priority Data

Feb. 5, 2021 (EP) ..... 21155505

(51) Int. Cl.
*G10L 25/51* (2013.01)
*H04R 1/08* (2006.01)
*H04R 25/00* (2006.01)

(52) U.S. Cl.
CPC ..... *G10L 25/51* (2013.01); *H04R 1/08* (2013.01); *H04R 25/00* (2013.01)

(58) Field of Classification Search
None
See application file for complete search history.

(56) References Cited

U.S. PATENT DOCUMENTS

2017/0123824 A1 5/2017 Franck
2019/0069098 A1 2/2019 Walsh et al.

FOREIGN PATENT DOCUMENTS

WO 2020021487 A1 1/2020

OTHER PUBLICATIONS

"Extended European Search Report received in EP Application No. 21155505.7-1210 dated Jul. 26, 2021".
Ayers, et al., "Could behavioral medicine lead the web data revolution?", JAMA 2014;311(14):1399-400.omid:24577162.
Caplan, et al. "Preference for Online Social Interaction: A Theory of Problematic Internet Use and Psychosocial Well-Being", Communication Research, 30(6), 625-648.
Dissing, et al. "Measuring social integration and tie strength with smartphone and survey data", PLoS ONE 13(8):e0200678. https://doi.org/10.1371/journal.pone.0200678.

(Continued)

*Primary Examiner* — Kenny H Truong
(74) *Attorney, Agent, or Firm* — ALG Intellectual Property, LLC

(57) ABSTRACT

A method for determining social interaction of a user wearing a hearing device which comprises at least one microphone and at least one classifier. The method comprises: receiving an audio signal from the at least one microphone and/or a sensor signal from the at least one further sensor; identifying, by the at least one classifier, one or more predetermined user activity values by evaluating the audio signal from the at least one microphone and/or the sensor signal from the at least one further sensor; and calculating a user social interaction metric indicative of the social interaction of the user from the identified user activity values, wherein the user activity values are assigned to predefined social interaction levels, and wherein the user social interaction metric is a function of the user activity values weighted with their respective contribution to each of the social interaction levels.

14 Claims, 2 Drawing Sheets

(56) References Cited

OTHER PUBLICATIONS

Holt-Lunstad, et al.,"Social relationships and mortality risk: a meta-analytic review", PLoS Med 2010; 7(7):e1000316. pmid:20668659.
Lazer, et al. ,"Life in the network: the coming age of computational social science", Science. 2009;323(5915):721-3.omid:19197046.
Ronald, et al.,"Modeling social interactions between individuals for joint activity scheduling", Transportation Research Part B. Methodological, vol. 46, No. 2, Feb. 28, 2012, pp. 276-290, XP028453596, ISSN: 0191-2615, DOI:10.1016/J.TRB.2011.10.003.
Smith, et al.,"Social Networks and Health", Annu Rev Sociol. 2008;34(1):405-29.

DETERMINING SOCIAL INTERACTION OF A USER WEARING A HEARING DEVICE

RELATED APPLICATIONS

The present application claims priority to EP Patent Application No. 21155505.7, filed Feb. 5, 2021, the contents of which are hereby incorporated by reference in their entirety.

BACKGROUND INFORMATION

Hearing devices are generally small and complex devices. Hearing devices can include a processor, microphone, an integrated loudspeaker as a sound output device, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Hearing impaired people often become less social active due to their hearing difficulties and encounter feelings such as loneliness. Social relations are important to human health. Both, structural aspects such as network size and contact frequency as well as functional aspects such as social support have been established as important determinants of human health and well-being during the last decades.

Most of the evidence related to social interaction of a person is based on self-reports from surveys. A list of questionnaires may be used in order to assess an extent or an intensity of the social relationships and of loneliness. Some topics that are typically covered in these questionnaires are: tracking conversations with closely related people (e.g. partner, family, friends) and with others (colleagues at work, school, sport/religious/volunteering groups) or what was the duration of the conversations, enjoyable activities etc. Other topics that are included in these questionnaires are the individual characteristic patterns of social behaviour of the people (e.g. time of going to bed, coming out of bed in the morning, first contact with a person at the phone, first contact face-to-face, first time to eat or drink something, to get outside from the home for the first time, to have lunch, to have dinner, physical exercise, watch TV, time of going to the cinema, playing, performance, conversations, time spent with a pet etc.).

Although traditional assessment methods exist for quite some time now, alternative ways of measuring social relations are emerging. Over the last decade, smartphones have become increasingly available and they provide a previously unthinkable framework for gaining detailed insights into human social interaction. Phone calls, online comments, GPS location and Wi-Fi-login may be automatically recorded. These kinds of 'big data' provide fine-grained information on human social interactions over time and place and are increasingly being used to study social relationships in relation to health. In relevant publications (see e.g. Dissing A S, Lakon C M, Gerds T A, Rod N H, Lund R (2018) "Measuring social integration and tie strength with smartphone and survey data" PLoS ONE 13(8): e0200678.), a study is described where they examine whether there is a correlation between information automatically obtained from smartphones and with self-reported social-interaction measures using questionnaires. It was found that there is a significant overlap between those two.

The aforementioned paragraphs indicate the potential of being able to track social interaction using phones.

On the other hand, in US 2019/0069098 A1, a computing system which determines, based on data received from a hearing-assistance device, a cognitive benefit measure for a wearer of the hearing-assistance device related to hearing-assistance device use is proposed. Specifically, the computing system is described to determine cognitive benefit measure sub-components such as an audibility sub-component which is a measure of an improvement in audibility provided to the wearer by the hearing-assistance device; an intelligibility sub-component that indicates a measure of an improvement in speech understanding provided by the hearing-assistance device; a comfort sub-component that indicates a measure of noise reduction provided by the hearing-assistance device; a sociability sub-component that indicates a measure of time spent in auditory environments involving speech; or a connectivity sub-component that indicates a measure of an amount of time the hearing-assistance device spent streaming media from devices connected wirelessly to the hearing-assistance device. This document aims at quantifying the cognitive benefit in general by taking into account all the different relevant areas of cognitive benefit such as audibility, intelligibility, focus, connectivity, sociality, comfort, but not specifically the social interaction as such.

Further, WO 2020/021487 A1 proposes habilitation and/or rehabilitation methods comprising capturing an individual's voice, and logging data corresponding to events and/or actions of the individual's real world auditory environment, wherein the user is speaking while using a hearing assistance device. This method aims at tracking whether some auditory skills, such as an ability to identify or comprehend the captured environmental sound or to communicate by responding to voice directed at the person, are being developed by a hearing impaired person, e.g a child. Specifically, it comprises analyzing the captured voice and the data to identify a habilitation and/or rehabilitation action that should be executed or should no longer be executed. Furthermore, the method specifically comprises determining, based on the captured voice, linguistic characteristics associated with the hearing impaired person, comprising e.g. a measure of proportion of time spent by the recipient speaking and/or receiving voice from others; a measure of quantity of words and/or sentences spoken by the recipient, of his conversational turns, phonetic features, voice quality, etc.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
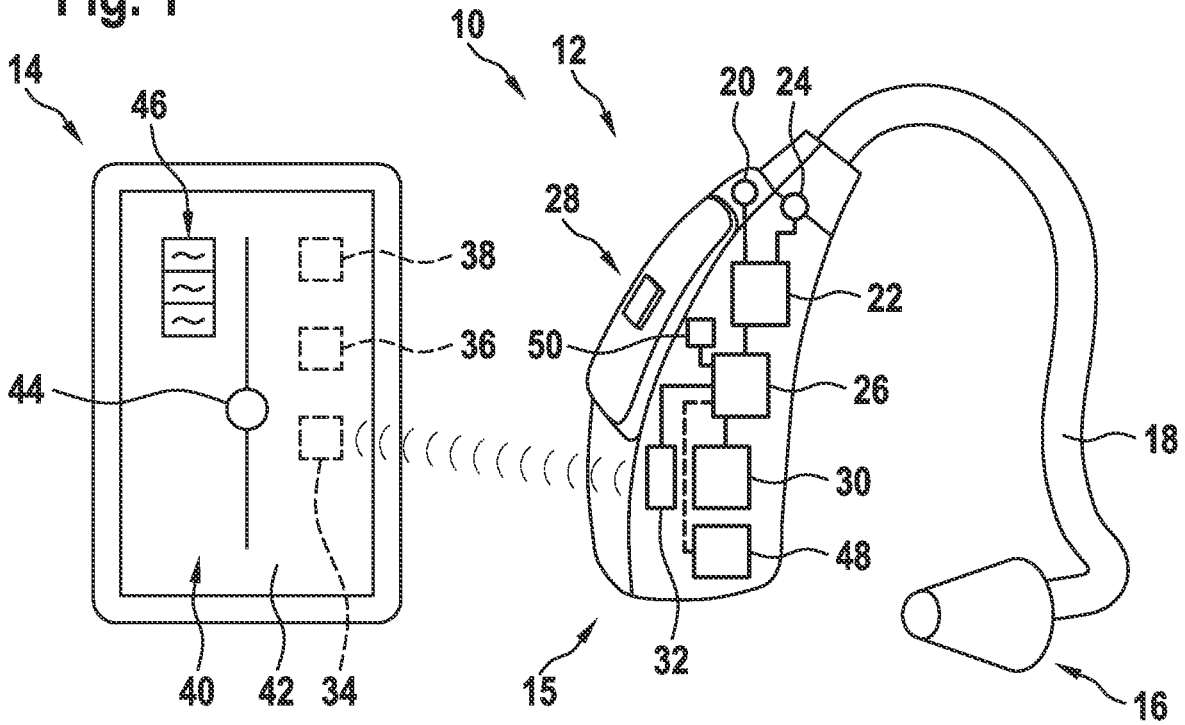
FIG. 1 schematically shows a hearing system according to an embodiment.

Described herein are a method, a computer program and a computer-readable medium for determining social interaction of a user wearing a hearing device which comprises at least one microphone. Furthermore, the embodiments described herein relate to a hearing system comprising at least one hearing device of this kind and optionally a connected user device, such as a smartphone.

It is a feature described herein to provide a method and system for obtaining information about the social interaction of the person, automatically, using a hearing device. It is a further feature to provide suitable sensors in combination with reliable techniques of evaluation of their sensor signal so as to monitor the effect of wearing a hearing device on the social interaction of its user in a most comprehensive manner.

A first aspect relates to a method for determining social interaction of a user while he/she is wearing a hearing device which comprises at least one microphone and at least one classifier. The classifier is configured such as to identify (and output) one or more predetermined user activity values and/or environments based on a signal from at least one microphone and/or from at least one further sensor.

The predetermined user activity values may, for example, be simply equal to 1, so as to indicate the presence of the respective user activity. However, any other predetermined value may be suitable as well, depending on the type of user activity to be identified.

The method may be a computer-implemented method, which may be performed automatically by a hearing system, part of which the user's hearing device is. The hearing system may, for instance, comprise one or two hearing devices used by the same user. One or both of the hearing devices may be worn on and/or in an ear of the user. A hearing device may be a hearing aid, which may be adapted for compensating a hearing loss of the user. Also a cochlear implant may be a hearing device. The hearing system may optionally further comprise at least one connected user device, such as a smartphone, smartwatch or other devices carried by the user and/or a personal computer etc.

According to an embodiment, the method comprises receiving an audio signal from the at least one microphone and/or a sensor signal from the at least one further sensor. The further sensor(s) may be any type(s) of physical sensor(s)—e.g. an accelerometer and/or optical and/or temperature sensor—integrated in the hearing device or possibly also in a connected user device such as a smartphone or a smartwatch.

According to an embodiment, the at least one classifier identifies the one or more predetermined user activity values by evaluating the audio signal received from the at least one microphone and/or the sensor signal received from the at least one further sensor. Based on the identified user activity values, a user social interaction metric indicative of the social interaction of the user is then calculated, wherein the user activity values are assigned and/or distributed to predefined social interaction levels, and wherein the user social interaction metric is a function of the user activity values weighted with their respective contribution to each of the social interaction levels. The function may depend on the user activity values times predefined weighting values which define their respective contribution to each of the social interaction levels.

According to an embodiment, the calculated user social interaction metric is then being saved, transmitted and/or displayed by the hearing system, part of which the hearing device is.

A basic idea is, thus, to provide an automatic method to determine or measure/quantify social interaction of the user using his/her hearing device. In other words, the proposed method provides a sociometer implemented in the user's hearing device or system and configured to automatically determine a user's social interaction metric (i.e. measure or quantity) while he/she is wearing the hearing device.

To this end, the social interaction of a person is classified according to a multiple-level scale of predefined social interaction levels. By way of example only, a possible definition of a three-level scale is used in the following to describe the method:

Level 1: Person with limited physical activity, who tends to stay isolated, and has few interactions with others (examples of activities: watching TV, reading, staying at home).

Level 2: Person with mid-to-high physical activity, who goes out frequently, yet having limited interactions with others (examples of activities: jogging, cinema, shopping).

Level 3: Person with mid-to-high physical activity, having strong interactions with others (examples of activities: restaurants, meetings, partying).

The present features suggest to make use of multiple hearing device features denoted as "classifiers", which are implemented in the hearing device or system and configured so as to identify the predetermined user activity values and/or environments where the user is in based on a signal received from the microphone and/or from at least one further sensor, in order to determine, for example, which one is the dominant social interaction level of the user.

According to an embodiment, at least one of the classifiers is configured so as to detect/identify one or more predetermined states characterizing the user's speaking activity and/or the user's acoustic environment, wherein a predetermined classification value is assigned to each state and output by the classifier as the corresponding user activity value.

For example, these predetermined states may be one or more of the following: Speech In Quiet; Speech In Noise; Being In Car; Reverberant Speech; Noise; Music; Quiet; Speech In Loud Noise. These are listed in the following exemplary Table 1. The different states contribute to the different levels of the social interaction scale according to their weighting values also included in the Table.

Every state (the corresponding user activity value being e.g. equal to 1, not explicitly shown in the Table) can be fully related (weighting value: 1), partly related (weighting value: e.g. 0.5 or any other number between 0 and 1) or not related (weighting value: 0) to the three different social interaction levels. For example, the state SpeechInQuiet fully relates to the Level 1 (e.g. TV), to the Level 2 (e.g. Cinema), and partly relates to the Level 3:

TABLE 1

An example with three "levels" of social interaction and the respective weighting values of the predetermined states identifiable by a classifier in this embodiment.

| | Social interaction | | |
|---|---|---|---|
| Classifier states | Level 1 | Level 2 | Level 3 |
| SpeechInQuiet | 1 | 1 | 0.5 |
| SpeechInNoise | 0 | 0.5 | 1 |
| InCar | 0 | 0.5 | 0.5 |
| ReverberantSpeech | 0.5 | 0.5 | 0.5 |
| Noise | 0.5 | 1 | 0.5 |
| Music | 1 | 0.5 | 0 |
| Quiet | 1 | 0 | 0 |
| SpeechInLoudNoise | 0 | 0 | 1 |

According to an embodiment, at least one of the user activity values is a value indicative of the user's physical activity determined by the respective classifier based on the sensor signal of an accelerometer and/or of a physical activity tracker provided in the hearing device.

For example, these predetermined user activity values may be indicative of one or more different movement types, such as Light Activity, Walking, Running, Jumping, Cycling, Swimming, Climbing etc., and/or of one or more different posture types, such as sedentary, upright, recumbent, off body etc., of the hearing device user. For example, a typical accelerometer of hearing aids may allow to distinguish between three different movement types and four different posture types as listed in the Table 2 and Table 3 below.

In this example, the three movement types (the corresponding user activity values being e.g. equal to 1, not explicitly shown in the Table) contribute to the different levels of the social interaction scale according to Table 2:

TABLE 2

An example with three "levels" of social interaction and the respective weighting values of the movement types identifiable with the help of a classifier based on an accelerometer.

| Movement types | Social interaction Level 1 | Level 2 | Level 3 |
|---|---|---|---|
| LightActivity | 1 | 0 | 0 |
| Walking | 0 | 0.5 | 0.5 |
| Running | 0 | 0.5 | 0.5 |

Further in this example, the four posture types mentioned above (the corresponding user activity values being e.g. equal to 1, not explicitly shown in the Table) correspond to the different levels of the social interaction scale according to the Table 3 below. The OffBody type may, for instance, be used to activate/deactivate the computation of the social interaction metric. In other words, it is thereby ensured that if the hearing device is not worn, the present method is not applied (as indicated by "n/a" in the Table).

TABLE 3

An example with three "levels" of social interaction and the respective weighting values of the posture types identifiable with the help of a classifier based on an accelerometer.

| Posture types | Social interaction Level 1 | Level 2 | Level 3 |
|---|---|---|---|
| Sitting | 0.5 | 0.5 | 0.5 |
| Standing | 0.5 | 0.5 | 0.5 |
| OffBody | n/a | n/a | n/a |

According to an embodiment, at least one of the user activity values is indicative of the presence of an assistive technology device integrated in the hearing device or being a part of the hearing system and connected to the hearing device (e.g. by wireless communication such as Bluetooth).

For example, referring to Phonak™, multiple assistive technology devices—such as additional wireless microphones to be put on a conference table or to be attached to the clothes of a conversation partner—are known that can help assess the social activity of their user. If one/several of this kind of solutions is/are paired (in the sense of wireless communication) to the user's hearing device system, they can contribute to the different levels of the social interaction scale according to the Table 4 below.

In Table 4, only exemplarily listed Phonak™-related assistive technology devices are denoted as TV Connector (device for audio streaming from any TV and stereo system), TVLink (an interface to TV and other audio sources), Roger™ Select (a versatile microphone for stationary situations where background noise is present), Roger™ Touchscreen Mic (easy to use wireless teacher microphone), Roger™ Table Mic (a microphone dedicated for working adults who participate in various meetings, configured to select the person who's talking and switch automatically between the meeting participants), Roger™ Pen (handy microphone for various listening situations, which, due to its portable design, can be conveniently used where additional support is needed over distance and in loud noise), Roger™ Clip-On Mic (small microphone designed for one-to-one conversations and featuring a directional microphone), PartnerMic (Easy-to-use lapel worn microphone for one-to-one conversations). Further assistive technology devices listed in Table 4 are known as Sound Cleaning App (a specific audio support app), HI2HI (a wireless personal communication network), and T-Coil (a small copper coil that functions as a wireless antenna)

TABLE 4

An example with three "levels" of social interaction and the respective weighting values assigned to the user activity values (being e.g. equal to 1, not explicitly shown in the Table) identifiable with the use of assistive technology devices.

| Devices | Social interaction Level 1 | Level 2 | Level 3 |
|---|---|---|---|
| TV Connector | 1 | 0 | 0 |
| TVLink | 1 | 0 | 0 |
| Roger Select | 0 | 0 | 1 |
| Roger Touchscreen Mic | 0 | 0 | 1 |
| Roger Table Mic | 0 | 0 | 1 |
| Roger Pen | 0 | 0 | 1 |
| Roger Clip-On Mic | 0 | 0.5 | 1 |
| PartnerMic | 0 | 0.5 | 1 |
| Sound Cleaning APP | 0 | 0.5 | 1 |
| Hearing aid to hearing aid communication (HI2HI) | 0 | 0.5 | 1 |
| T-Coil | 0 | 1 | 0.5 |

According to an embodiment, at least one of the user activity values is indicative of the user's own-voice activity determined by the respective classifier based on the audio signal from the at least one microphone and/or the sensor signal from the at least one further sensor. The availability of such an own-voice detector in hearing devices could be a great contributor to the social interaction scale. Indeed, it would help differentiate between ambiguous cases: for example, if the classifier shown in Table 1 reports a SpeechInQuiet-environment, the classifier configured for identifying the user's own voice activity would help to know whether the user is currently watching TV (no own-voice activity) or attending a meeting as an active participant (own-voice activity present). This is illustrated in Table 5 below showing exemplary weighting values reflecting a contribution of detected (i.e. identified) own-voice activity of the user to the three different social interaction levels:

TABLE 5

| An example with "levels" of social interaction and how the own voice activity would relate to them. | | | |
|---|---|---|---|
| | Level 1 | Level 2 | Level 3 |
| Own Voice Activity | Low (0) | Mid (0.5) | High (1) |

In the following, some approaches to define a metric which can be used to determine the user's "social interaction level" are presented:

According to an embodiment, the user social interaction metric is defined as an overall social interaction score summed up over the different social interaction levels. In this embodiment, an overall score, e.g. between 0 (=no interaction) and 100 (=full interaction), may be computed, for instance, based on:

- Audio sensors (microphones): using a classifier of states (cf. Table 1 above)+a classifier of the own-voice activity (cf. Table 5 above); and/or
- Motion sensors (accelerometers): using a classifier of physical activity (cf. Table 2 and Table 3 above); and/or
- Optional assistive technologies, where available: using a classifier of assistive technology devices (cf. Table 4 above).

Alternatively, an individual score for each of the different social interaction levels may be calculated; and the user social interaction metric be defined as the social interaction level with the highest calculated score. In this embodiment, a score for each of the three levels of social interaction as mentioned above, or a score for each of two or more levels defined in any other suitable manner, is computed based e.g. on a similar sensor and classifier information as in the previous embodiment.

The following example illustrates how the scores S associated to each of the three levels of social interaction may be computed over a day using the classifiers shown in Table 1, Table 2, Table 3 and Table 4 above. The user activity values of the different types listed in the Tables 1-4 are denoted as "p" or "flag" with a corresponding type index (such as "SiQ" for "Speech In Quiet" and "RvS" for "Reverberant Speech") and are summed up over a day (or any other predetermined time interval of monitoring) times the respective weighting values (equal to 0; 0.5 or 1 in this example) according to the Tables 1-4:

Score of Level 1:

$$S_1 = (1 - flag_{OffBody}) \times \left(\alpha_{audio}\left(\sum_{day} p_{SiQ} + 0.5\sum_{day} p_{RvS} + 0.5\sum_{day} p_N + \sum_{day} p_{Mus} + \sum_{day} p_Q\right) + \alpha_{movement}\left(\sum_{day} flag_{LightAct}\right) + \alpha_{posture}\left(0.5\sum_{day} flag_{Sit}\right) + \alpha_{device}\left(\sum_{day} flag_{TV}\right)\right)$$

Score of Level 2:

$$S_2 = (1 - flag_{OffBody}) \times \left(\alpha_{audio}\left(\sum_{day} p_{SiQ} + 0.5\sum_{day} p_{SiN} + 0.5\sum_{day} p_{iC} + 0.5\sum_{day} p_{RvS} + \sum_{day} p_N + 0.5\sum_{day} p_{Mus}\right) + \alpha_{movement}\left(0.5\sum_{day} flag_{Walk} + 0.5\sum_{day} flag_{Run}\right) + \alpha_{posture}\left(0.5\sum_{day} flag_{Sit} + 0.5\sum_{day} flag_{Stand}\right) + \alpha_{device}\left(0.5\sum_{day} flag_{PartnerMic} + \sum_{day} flag_{SoundCleaning} + 0.5\sum_{day} flag_{HI2HI} + \sum_{day} flag_{TCoil}\right)\right)$$

Score of Level 3:

$$S_3 = (1 - flag_{OffBody}) \times \left(\alpha_{audio}\left(0.5\sum_{day} p_{SiQ} + \sum_{day} p_{SiN} + 0.5\sum_{day} p_{iC} + 0.5\sum_{day} p_{RvS} + 0.5\sum_{day} p_N + \sum_{day} p_{SiLN}\right) + \alpha_{movement}\left(0.5\sum_{day} flag_{Walk} + 0.5\sum_{day} flag_{Run}\right) + \alpha_{posture}\left(0.5\sum_{day} flag_{Sit} + 0.5\sum_{day} flag_{Stand}\right) + \alpha_{device}\left(\sum_{day} flag_{Roger} + 0.5\sum_{day} flag_{SoundCleaning} + \sum_{day} flag_{HI2HI} + 0.5\sum_{day} flag_{TCoil}\right)\right)$$

In this example, optional predefined factors $\alpha_{audio}$, $\alpha_{movement}$, $\alpha_{posture}$, and $\alpha_{device}$ additionally take into account a weight given to every user activity value type, the refresh rate of every user activity value type e.g. per hour, and ensure the mathematical homogeneity of the different added components.

Beside those user activity values mentioned above, further user activity values characterizing the user's social environment and contributing to a determination of his social interaction level may be, for example, identifiable as one or more of the following (also referred to as a classifier performing a "conversation analysis" in FIG. 3 further below):

- switching between different conversational partners in short time versus talking to one person;
- talking to "new" people (speaker identification);
- number of different conversation partners over long-term;
- number of Conversational turns resp. to how quick the speakers switch;
- rate of word count between own-voice versus conversational partner;
- duration of conversation.

In addition, as mentioned at the beginning, a list of questionnaires can be used in order to assess an extent or an intensity of the social relationships and of loneliness. These questionnaires may be filled in by the person and the questions be rated accordingly. This may be used to investigate the ability of detecting some of the activities related to the questionnaires by using the automatic functions (classifiers) of the hearing device as described in the present method. For example, being able to track conversations with closely related people (e.g. partner, family, friends) and with others (colleagues at work, school, sport/religious/volunteering groups) and determining who was the conversation partner and the duration of the conversation.

Several other questions could be stated that relate to the individual's characteristic pattern of social behaviour (e.g. time of going to bed, coming out of bed in the morning, first contact with a person at the phone, first contact face-to-face, first time to eat or drink something, to get outside from the home for the first time, to have lunch, to have dinner, physical exercise, watch TV, time of going to the cinema, playing, performance, conversations, time spent with a pet etc.). Such activities can also be tracked with the help of a hearing device using the method proposed herein.

Another metric component that could also be appropriate to track by a suitable classifier of the present method is the time spent in online social network apps with the mobile phone, since there is some evidence (see, for example, Caplan, S. E. (2003): "Preference for Online Social Interaction: A Theory of Problematic Internet Use and Psychosocial Well-Being." Communication Research, 30(6), 625-648.) that has shown that lonely and depressed individuals may develop a preference for online social interaction, which, in turn, leads to negative outcomes associated with their Internet use.

According to an embodiment, the one or more predetermined user activity values are identified based on the audio signal from the at least one microphone and/or the sensor signal from the at least one further sensor received over a predetermined time interval (such as a day, or a week, or a month). The user social interaction metric is then calculated at the end of this time interval, and the function is based on summing up the identified user activity values times, the weighting values indicating their contribution to the respective social activity level (and, as the case may be, times further appropriate weights) over this time interval (cf. the above example of calculating the scores S of the three social interaction levels to determine the metric as the level with the highest score S).

This embodiment may also be used in a further embodiment which yields a relative social interaction metric, which may be particularly informative for the users using a hearing device for the first time:

Here, the one or more predetermined user activity values are determined over two identical predetermined time intervals separated by a predetermined pause interval (such as 6 months or a year) and the user social interaction metrics calculated at the end of each of these two identical time intervals are compared so as to define a progress in the social interaction of the user due to using the hearing device.

In other words, to receive a relative social interaction metric, the social interaction metric is calculated based on the approaches presented above for people using hearing devices, in particular for the first time users. The social interaction metric is calculated for a specific time period (e.g. 3 weeks). Then, this metric is calculated in the same manner again at a later time (after six months or after a year) for the same period of time (e.g. 3 weeks). With thus repeated calculation, one obtains an automatic tool revealing how the metric (which is highly correlated with social interaction of the user) evolves over time and whether the user has become more "socially active" with the help of his/her hearing devices.

According to an embodiment, the method further comprises a step of detecting whether the user is actually wearing the hearing device and only continuing with the method if the user is wearing the hearing device. As mentioned above, this may, for example, be implemented by a classifier based on the sensor signal of an accelerometer and/or of a physical activity tracker provided in the hearing device. This may ensure that if the hearing device is not worn, the present method is not applied (as indicated by "n/a" in Table 3 further above).

Further aspects relate to a computer program for determining social interaction of a user wearing a hearing device which comprises at least one microphone and at least one classifier configured to identify one or more predetermined user activity values based on a signal from the at least one microphone and/or from at least one further sensor, which program, when being executed by a processor, is adapted to carry out the steps of the method as described above and in the following as well as to a computer-readable medium, in which such a computer program is stored.

For example, the computer program may be executed in a processor of a hearing device, which hearing device, for example, may be carried by the person behind the ear. The computer-readable medium may be a memory of this hearing device. The computer program also may be executed by a processor of a connected user device, such as a smartphone or any other type of mobile device, which may be a part of the hearing system, and the computer-readable medium may be a memory of the connected user device. It also may be that some steps of the method are performed by the hearing device and other steps of the method are performed by the connected user device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect relates to a hearing system comprising a hearing device worn by a hearing device user, as described herein above and below, wherein the hearing system is adapted for performing the method described herein above and below. The hearing system may further include, by way of example, a second hearing device worn by the same user and/or a connected user device, such as a smartphone or other mobile device or personal computer, used by the same user.

According to an embodiment, the hearing device comprises: a microphone; a processor for processing a signal from the microphone; a sound output device for outputting the processed signal to an ear of the hearing device user; a transceiver for exchanging data with the connected user device and/or with another hearing device worn by the same user; and at least one classifier configured to identify one or more predetermined user activity values based on a signal from the at least one microphone and/or from at least one further sensor.

It has to be understood that features of the method as described above and in the following may be features of the computer program, the computer-readable medium and the hearing system as described above and in the following, and vice versa.

These and other aspects will be apparent from and elucidated with reference to the embodiments described hereinafter.

FIG. 1 schematically shows a hearing system 10 including a hearing device 12 in the form of a behind-the-ear device carried by a hearing device user (not shown) and a connected user device 14, such as a smartphone or a tablet computer. It has to be noted that the hearing device 12 is a specific embodiment and that the method described herein also may be performed with other types of hearing devices, such as in-the-ear devices.

The hearing device 12 comprises a part 15 behind the ear and a part 16 to be put in the ear channel of the user. The part 15 and the part 16 are connected by a tube 18. In the part 15, at least one microphone 20, a sound processor 22 and a sound output device 24, such as a loudspeaker, are provided. The microphone(s) 20 may acquire environmental sound of the user and may generate a sound signal, the sound processor 22 may amplify the sound signal and the sound output device 24 may generate sound that is guided through the tube 18 and the in-the-ear part 16 into the ear channel of the user.

The hearing device 12 may comprise a processor 26 which is adapted for adjusting parameters of the sound processor 22 such that an output volume of the sound signal is adjusted based on an input volume. These parameters may be determined by a computer program run in the processor 26. For example, with a knob 28 of the hearing device 12, a user may select a modifier (such as bass, treble, noise suppression, dynamic volume, etc.) and levels and/or values of these modifiers may be selected, from this modifier, an adjustment command may be created and processed as described above and below. In particular, processing parameters may be determined based on the adjustment command and based on this, for example, the frequency dependent gain and the dynamic volume of the sound processor 22 may be changed. All these functions may be implemented as computer programs stored in a memory 30 of the hearing device 12, which computer programs may be executed by the processor 22.

The hearing device 12 further comprises a transceiver 32 which may be adapted for wireless data communication with a transceiver 34 of the connected user device 14, which may be a smartphone or tablet computer. It is also possible that the above-mentioned modifiers and their levels and/or values are adjusted with the connected user device 14 and/or that the adjustment command is generated with the connected user device 14. This may be performed with a computer program run in a processor 36 of the connected user device 14 and stored in a memory 38 of the connected user device 14. The computer program may provide a graphical user interface 40 on a display 42 of the connected user device 14.

For example, for adjusting the modifier, such as volume, the graphical user interface 40 may comprise a control element 44, such as a slider. When the user adjusts the slider, an adjustment command may be generated, which will change the sound processing of the hearing device 12 as described above and below. Alternatively or additionally, the user may adjust the modifier with the hearing device 12 itself, for example via the knob 28.

The user interface 40 also may comprise an indicator element 46, which, for example, displays a currently determined listening situation.

The hearing device 12 further comprises at least one classifier 48 configured to identify one or more predetermined user activity values (as described in detail herein above, in particular with reference to the above exemplary Tables 1 to 5) based on a signal from the microphone(s) 20 and/or from at least one further sensor (not explicitly shown in the Figure).

FIG. 1 furthermore shows that the hearing device 12 may comprise further internal sensors, such as an accelerometer 50.

The hearing system 10 shown in FIG. 1 is adapted for performing a method for determining social interaction of a user wearing the hearing device 12 and provided with the at least one integrated microphone 20 and the at least one classifier 48 as described in more detail herein above.

Figure 2:
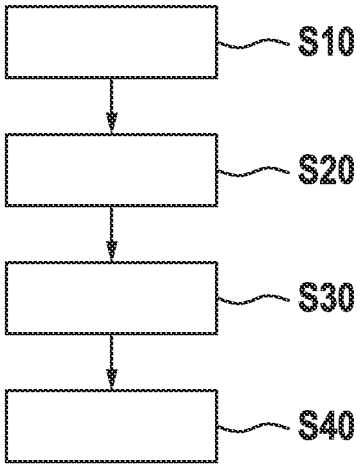
FIG. 2 shows a flow diagram of a method according to an embodiment for determining social interaction of a user wearing a hearing device of the hearing system of FIG. 1.

FIG. 2 shows an example for a flow diagram of this method according to an embodiment. The method may be a computer-implemented method performed automatically in the hearing system 10 of FIG. 1.

In a first step S10 of the method, an audio signal from the at least one microphone 20 and/or a sensor signal from the at least one further sensor is received, e.g. by the sound processor 22 and the processor 26 of the hearing device 12.

In a second step S20 of the method, the signal(s) received in step S10 are evaluated by the one or more classifiers 48 implemented in the hearing device 12 and system 10 so as to identify the presence and/or the intensity of one or more predetermined user activities and to output the result as predetermined user activity values, which may, in the most simple case, take the values 0 (if the respective user activity is not identified) or 1 (if the respective user activity is identified). If, as the case may be, a quantification of a user activity (such as e.g. a number of words or sentences spoken by the user or a number of his conversational partners in a group etc. etc.) is possible and suitable for being used when determining the user's social interaction metric in the following step (S30), the user activity values identifiable by the respective classifier 48 may also take values different from 0 and 1. The identified user activity values may be, for example, output by the classifiers 48 to the processor 26 performing the method, as only symbolically indicated by the dashed line in FIG. 1. It also may be that the classifiers 48 are implemented in the processor 26 itself or are stored as program modules in the memory so as to be performed by the processor 26. As already mentioned herein above, it also may be that all or some of the steps of the method are performed by the processor of the connected user device 14 as well.

In a third step S30 of the method, a user social interaction metric indicative of the social interaction of the user is calculated from the identified user activity values (as described in more detail herein), wherein the user activity values are distributed to predefined social interaction levels, and wherein the user social interaction metric is a function of the user activity values times predefined weighting values which define their respective contribution to each of the social interaction levels.

In a fourth step S40, the calculated user social interaction metric may be, for example, saved in the memory 30 or 38 for further use, transmitted to the connected user device 14 or to an external device such as a central server or a computer at a hearing professional's office or another medical or industrial office predefined in the hearing system 10, and/or displayed to the user at the display 42 of the connected user device.

Figure 3:
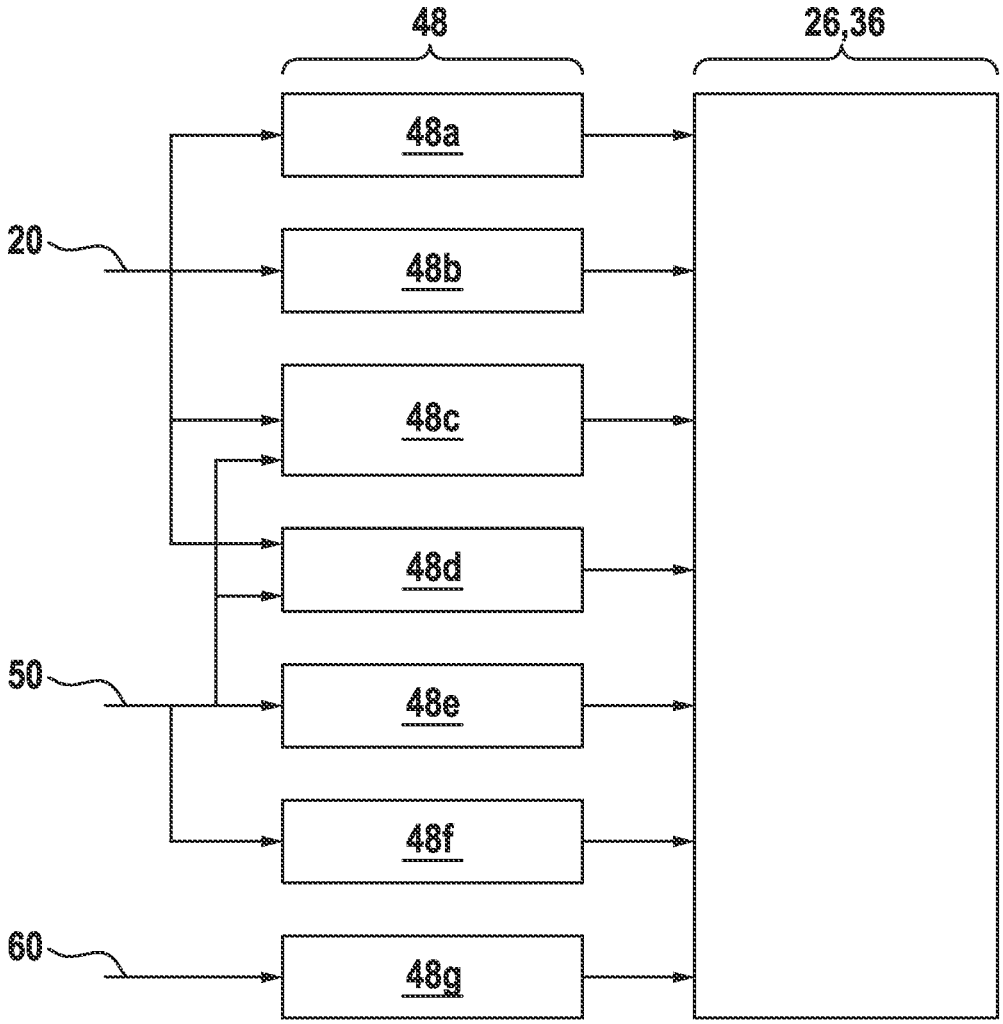
FIG. 3 shows a schematic block diagram of a method according to an embodiment.

Summing up the different elements, examples and approaches of determining the social interaction metric of a person described in more detail herein, FIG. 3 shows a schematic block diagram of a method according to an embodiment, which may serve as a framework for the present method. The method may be a computer-implemented method performed automatically in the hearing system 10 of FIG. 1, e.g. according to the flow diagram of FIG. 2.

On the left, FIG. 3 shows different types of sensors or devices delivering the microphone and other sensor signals to various types 48*a*-48*g* of the classifiers 48. These sensors and devices may be, for example, one or more microphones 20, accelerometers 50 and other physical activity sensors/trackers, assistive technology devices 60 etc. As schematically indicated in FIG. 3 by the arrows, the respective signals a fed into the different classifiers 48*a*-48*g*. For example, 48*a* may be a classifier identifying the user's own-voice activity (such as described with reference to Table 5 further above),

48*b* may be a classifier identifying that the user is in a car (such as described with reference to Table 1 further above), 48*c* may be a classifier performing a conversation analysis of the user (such as mentioned further above), 48*d* may be a classifier identifying social and daily habits of the user (such as mentioned further above), 48*e* may be a classifier identifying physical activity of the user (such as described with reference to Table 2 further above), 48*f* may be a classifier identifying a posture of the user (such as described with reference to Table 3 further above), 48*g* may be a classifier identifying that the user is using an assistive technology device (such as described with reference to Table 4 further above).

The predetermined user activity values identified by all the different classifiers 48 are then fed/output in FIG. 3 into the processor 26 or 36 or any other suitable unit calculating the user social interaction metric, as described in more detail herein.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 hearing device
14 connected user device
15 part behind the ear
16 part in the ear
18 tube
20 microphone(s)
22 sound processor
24 sound output device
26 processor
28 knob
30 memory
32 transceiver
34 transceiver
36 processor
38 memory
40 graphical user interface
42 display
44 control element, slider
46 indicator element
48 classifier
48*a-g* different classifier types
50 accelerometers and/or other physical activity sensors and trackers
60 assistive technology devices
S score

What is claimed is:

1. A method for determining social interaction of a user wearing a hearing device which comprises at least one microphone and at least one classifier configured to identify one or more predetermined user activity values based on a signal from the at least one microphone and/or from at least one further sensor, the method comprising:

receiving an audio signal from the at least one microphone and/or a sensor signal from the at least one further sensor;

identifying, by the at least one classifier, one or more predetermined user activity values by evaluating the audio signal from the at least one microphone and/or the sensor signal from the at least one further sensor;

calculating a user social interaction metric indicative of the social interaction of the user from the identified user activity values, wherein the user activity values are assigned to predefined social interaction levels, and wherein the user social interaction metric is a function of the user activity values weighted with their respective contribution to each of the social interaction levels.

2. The method of claim 1, wherein at least one of the classifiers is configured so as to identify one or more predetermined states characterizing the user's speaking activity and/or the user's acoustic environment, and wherein a predetermined classification value is assigned to each state and output by the classifier as the user activity value.

3. The method of claim 2, wherein the one or more predetermined states are one or more of the following:

Speech In Quiet;
Speech In Noise;
Being In Car;
Reverberant Speech;
Noise;
Music;
Quiet;
Speech In Loud Noise.

4. The method of claim 1, wherein at least one of the user activity values is a value indicative of the user's physical activity identified by the respective classifier based on the sensor signal of an accelerometer and/or of a physical activity tracker provided in the hearing device.

5. The method of claim 4, wherein these predetermined user activity values are indicative of one or more different movement types and/or one or more different posture types.

6. The method of claim 1, wherein at least one of the user activity values is indicative of the presence of an assistive technology device integrated in the hearing device or being a part of a hearing system and connected to the hearing device.

7. The method of claim 1, wherein at least one of the user activity values is indicative of the user's own-voice activity identified by one or more of the at least one classifier based on the audio signal from the at least one microphone and/or the sensor signal from the at least one further sensor.

8. The method of claim 1, wherein the user social interaction metric is defined as an overall social interaction score summed up over the different social interaction levels.

9. The method of claim 1, wherein an individual score (S) for each of the different social interaction levels is calculated; and the user social interaction metric is defined as the social interaction level with the highest calculated score (S).

10. The method of claim 1, wherein the one or more predetermined user activity values are identified based on the audio signal from the at least one microphone and/or the sensor signal from the at least one further sensor received over a predetermined time interval; and the user social interaction metric is calculated at the end of this time interval, and the function is based on summing up the identified user activity values times the weighting values indicating their contribution to the respective social activity level over this time interval.

11. The method of claim 10, wherein the one or more predetermined user activity values are identified based on the audio signal from the at least one microphone and/or the sensor signal from the at least one further sensor received over two identical predetermined time intervals separated by a predetermined pause interval; and the user social interaction metrics calculated at the end of each of these two identical time intervals are compared so as to define a progress in the social interaction of the user due to using the hearing device.

12. The method of claim 1, further comprising:

detecting whether the user is wearing the hearing device and only continuing with the method if the user is wearing the hearing device.

13. A computer program for determining social interaction of a user wearing a hearing device which comprises at least one microphone and at least one classifier configured to identify one or more predetermined user activity values based on a signal from the at least one microphone and/or from at least one further sensor, which program, when being executed by a processor, is adapted to carry out a method comprising:

receiving an audio signal from the at least one microphone and/or a sensor signal from the at least one further sensor;

identifying one or more predetermined user activity values by evaluating the audio signal from the at least one microphone and/or the sensor signal from the at least one further sensor;

calculating a user social interaction metric indicative of the social interaction of the user from the identified user activity values, wherein the user activity values are assigned to predefined social interaction levels, and wherein the user social interaction metric is a function of the user activity values weighted with their respective contribution to each of the social interaction levels.

14. A hearing system comprising a hearing device worn by a hearing device user and a connected user device, wherein the hearing device comprises:

a microphone;

a processor for processing a signal from the microphone;

a sound output device for outputting the processed signal to an ear of the hearing device user;

a transceiver for exchanging data with the connected user device;

at least one classifier configured to identify one or more predetermined user activity values based on a signal from the at least one microphone and/or from at least one further sensor; and wherein the hearing system is adapted for performing a method comprising:

receiving an audio signal from the at least one microphone and/or a sensor signal from the at least one further sensor;

identifying one or more predetermined user activity values by evaluating the audio signal from the at least one microphone and/or the sensor signal from the at least one further sensor;

calculating a user social interaction metric indicative of the social interaction of the user from the identified user activity values, wherein the user activity values are assigned to predefined social interaction levels, and wherein the user social interaction metric is a function of the user activity values weighted with their respective contribution to each of the social interaction levels.

* * * * *